US008872488B2

(12) United States Patent
Yoon et al.

(10) Patent No.: US 8,872,488 B2
(45) Date of Patent: Oct. 28, 2014

(54) VOLTAGE REGULATOR INCLUDING COMPENSATION CIRCUIT AND MEMORY DEVICE INCLUDING VOLTAGE REGULATOR

(75) Inventors: Gil Won Yoon, Hwaseong-si (KR); Dong Il Jung, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 153 days.

(21) Appl. No.: 13/549,154

(22) Filed: Jul. 13, 2012

(65) Prior Publication Data

US 2013/0015832 A1 Jan. 17, 2013

(30) Foreign Application Priority Data

Jul. 14, 2011 (KR) ..... 10-2011-0070117

(51) Int. Cl.
*G05F 1/00* (2006.01)
*G05F 1/575* (2006.01)

(52) U.S. Cl.
CPC ..... *G05F 1/575* (2013.01)
USPC ..... 323/273

(58) Field of Classification Search
USPC ..... 323/268–275
See application file for complete search history.

(56) References Cited

U.S. PATENT DOCUMENTS

| | | | | |
|---|---|---|---|---|
| 6,744,305 | B2 | 6/2004 | Oikawa et al. | |
| 7,002,869 | B2 | 2/2006 | Zhang et al. | |
| 7,501,883 | B2 * | 3/2009 | Cho | 327/540 |
| 7,831,845 | B2 * | 11/2010 | Lee | 713/300 |
| 8,072,198 | B2 * | 12/2011 | Imura | 323/276 |
| 8,138,741 | B2 * | 3/2012 | Kim et al. | 323/297 |
| 2002/0027427 | A1 * | 3/2002 | Kinoshita et al. | 323/266 |
| 2003/0042971 | A1 * | 3/2003 | Oikawa et al. | 327/540 |
| 2004/0174150 | A1 * | 9/2004 | Zhang et al. | 323/274 |
| 2009/0045796 | A1 * | 2/2009 | Kang et al. | 323/318 |
| 2012/0008431 | A1 * | 1/2012 | Lee | 365/191 |
| 2012/0062192 | A1 * | 3/2012 | Okuma | 323/272 |
| 2012/0218019 | A1 * | 8/2012 | Lee et al. | 327/331 |
| 2012/0256675 | A1 * | 10/2012 | Lee | 327/333 |

FOREIGN PATENT DOCUMENTS

| | | | |
|---|---|---|---|
| JP | 2003-76431 | A | 3/2003 |
| JP | 2003-330551 | A | 11/2003 |
| JP | 2004-273103 | A | 9/2004 |
| KR | 10-2004-0079119 | A | 9/2004 |

* cited by examiner

*Primary Examiner* — Timothy J Dole
*Assistant Examiner* — Yusef Ahmed
(74) *Attorney, Agent, or Firm* — Sughrue Mion, PLLC

(57) ABSTRACT

A voltage regulator and a memory device including same are provided. The voltage provider includes a resistive circuit configured to output at least one divided voltage; at least one driver circuit configured to be connected to the resistive circuit and to set the at least one divided voltage; and a compensation circuit configured to be connected to the at least one driver circuit, to receive a predetermined voltage, and to apply a power supply voltage to the at least one driver circuit. The at least one driver circuit may set the at least one divided voltage based on the power supply voltage received from the compensation circuit.

17 Claims, 8 Drawing Sheets

VOLTAGE REGULATOR INCLUDING COMPENSATION CIRCUIT AND MEMORY DEVICE INCLUDING VOLTAGE REGULATOR

CROSS-REFERENCE TO RELATED APPLICATIONS

This application claims priority from Korean Patent Application No. 10-2011-0070117 filed on Jul. 14, 2011, the disclosure of which is hereby incorporated by reference in its entirety.

BACKGROUND

Apparatuses consistent with the exemplary embodiments relate to a voltage regulator and a memory device including the same, and more particularly, to a voltage regulator for driving both high and low output voltages and having a good power supply rejection ratio (PSRR) and a memory device including the same.

A voltage regulator is a circuit which provides a regulated output voltage with a reference voltage as an input. The voltage regulator is desired to be designed to drive both high and low output voltages and to provide a good PSRR as well. However, related art voltage regulators do not satisfy both conditions.

SUMMARY

According to an aspect of an exemplary embodiment, there is provided a voltage regulator including a resistive circuit configured to output at least one divided voltage; at least one driver circuit configured to be connected to the resistive circuit and to set the at least one divided voltage; and a compensation circuit configured to be connected to the at least one driver circuit, to receive a predetermined voltage, and to apply a power supply voltage to the at least one driver circuit.

The at least one driver circuit may set the at least one divided voltage based on the power supply voltage received from the compensation circuit.

The compensation circuit may include a diode-connected transistor, which has a first terminal, a second terminal, and a gate terminal, the first terminal receives the predetermined voltage, the second terminal and the gate terminal are diode-connected to each other, and the compensation circuit may apply the power supply voltage to the at least one driver circuit through the second terminal and the gate terminal.

The power supply voltage may be lower than the predetermined voltage by a diode forward voltage drop.

The resistive circuit may include at least two resistors connected in series to each other, and at least one of the at least two resistors are connected between the first and second terminals of the at least one transistor of the at least one driver circuit.

A first end of the series of the at least two resistors may be connected to a ground voltage. An output voltage of the voltage regulator may be measured at a second end of the series of the at least two resistors.

The diode-connected transistor may be a p-type metal oxide semiconductor (pMOS) transistor.

The at least one transistor may be an n-type metal oxide semiconductor (nMOS) transistor or a p-type metal oxide semiconductor (pMOS) transistor.

According to another aspect of an exemplary embodiment, there is provided a voltage regulator including a resistive circuit configured to include at least two resistors connected in series to each other and to output a divided voltage of the voltage regulator; at least one pair of metal oxide semiconductor (MOS) transistors, wherein a first MOS transistor of the at least one pair of MOS transistors has a first terminal connected to a first end of a first resistor of the at least two resistors, and a second MOS transistor of the at least one pair of MOS transistors has a second terminal connected to a second end of a second resistor of the at least two resistors; at least one pair of inverters configured to have output terminals connected to respective gates of the at least one pair of MOS transistors; and a diode-connected transistor configured to be connected to the at least one pair of inverters and to have a first terminal receiving a predetermined voltage, a second terminal outputting a power supply voltage to the at least one pair of inverters, and a gate diode-connected to the second terminal.

According to an aspect of another exemplary embodiment, there is provided a memory device including the above-described voltage regulator and a row decoder configured to be connected to the voltage regulator and to select a row in a memory cell array using a voltage output from the voltage regulator.

BRIEF DESCRIPTION OF THE DRAWINGS

The above and/or other aspects will become more apparent by describing in detail exemplary embodiments with reference to the attached drawings in which.

DETAILED DESCRIPTION

Figure 1:
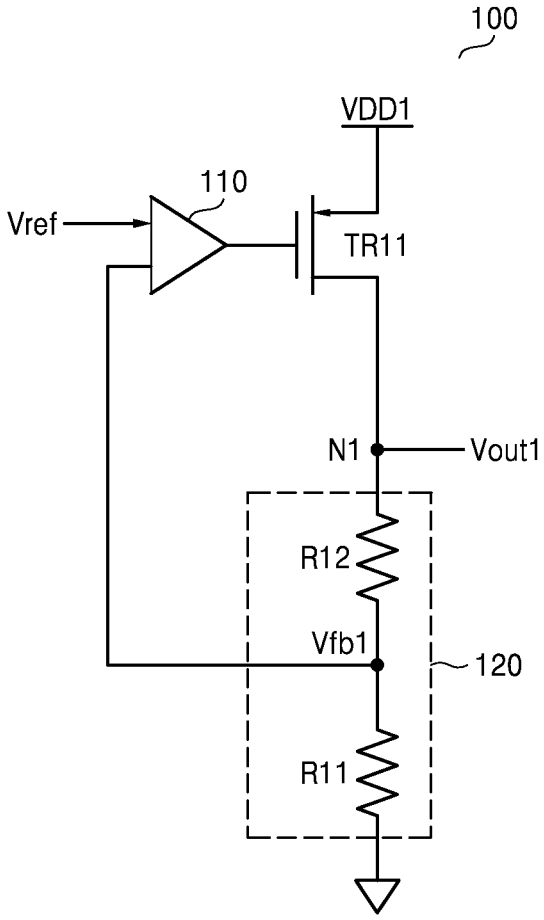
FIG. 1 is a diagram of a voltage regulator in a comparison example.

Exemplary embodiments will be described more fully hereinafter with reference to the accompanying drawings. The inventive concept may, however, be embodied in many different forms and should not be construed as limited to the exemplary embodiments set forth herein. Rather, these exemplary embodiments are provided so that this disclosure will be thorough and complete. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular exemplary embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the exemplary embodiments belong. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

FIG. 1 is a diagram of a voltage regulator 100 in a comparison example. The voltage regulator 100 includes an amplifier 110, a first transistor TR11 and a resistive circuit 120. The first transistor TR11 may be a p-type metal oxide semiconductor (pMOS) transistor.

The amplifier 110 receives a reference voltage Vref and a divided voltage Vfb1, which may be determined according to the reference voltage Vref. An output terminal of the amplifier 110 is connected to a gate of the first transistor TR11.

The first transistor TR11 has a terminal connected to a predetermined voltage VDD1 and another terminal connected to the resistive circuit 120 via an output voltage node N1.

The resistive circuit 120 may include a first resistor R11 and a second resistor R12 that are connected in series. The divided voltage Vfb1 is generated at a node connected between the first and second resistors R11 and R12.

The first resistor R11 is also connected to a ground voltage and the second resistor R12 is connected to the output voltage node N1.

The resistive circuit 120 may determine the divided voltage Vfb1 and an output voltage Vout1 based on the reference voltage Vref and a resistance ratio between the first and second resistors R11 and R12. For instance, when the reference voltage Vref is 1 V and the resistance ratio, $$\frac{R11}{R11+R12},$$

is 0.5, the divided voltage Vfb1 is 1 V and the output voltage Vout1 is 2 V.

The resistance value of the first resistor R11 may be the same as or different from that of the second resistor R12, which may be depend on a designer's choice.

The two resistors R11 and R12 are connected in series in the comparison example shown in FIG. 1, but the number of resistors may be changed.

A power supply rejection ratio (PSRR) is defined by Equation 1:

$$PSRR = 20\log\frac{\Delta VDD1}{\Delta Vout1}. \quad \text{(Equation 1)}$$

According to Equation 1, as the PSRR increases, voltage fluctuation at the output voltage node N1 decreases.

In the voltage regulator 100 illustrated in FIG. 1, when the output voltage Vout1 needs to be changed, the resistance of the first and second resistors R11 and R12 also need to be changed.

Figure 2:
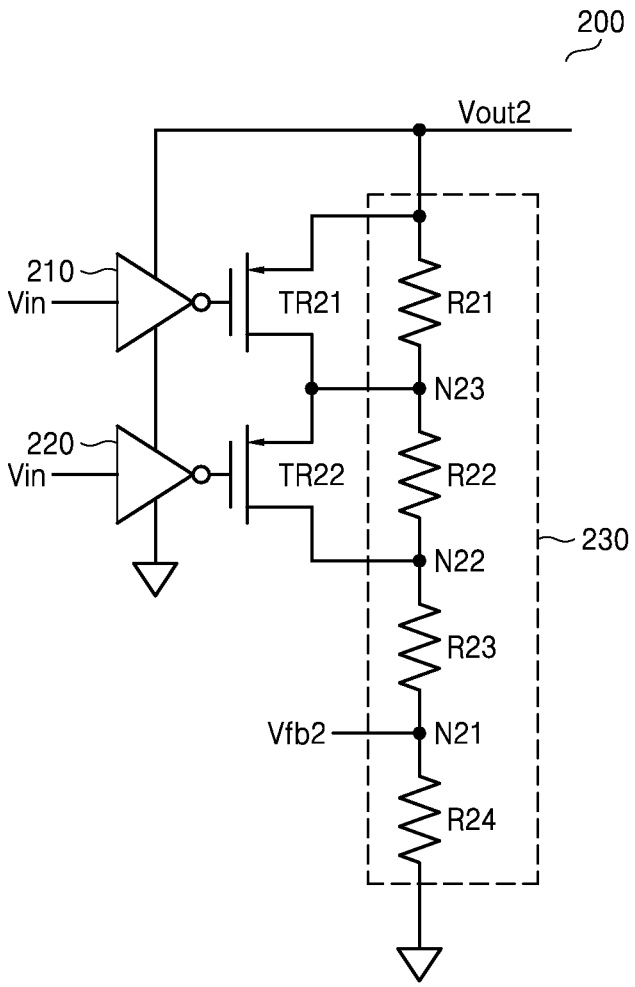
FIG. 2 is a diagram of a voltage regulator in another comparison example.

FIG. 2 is a diagram of a voltage regulator 200 in another comparison example. Referring to FIG. 2, the voltage regulator 200 includes a first inverter 210, a second inverter 220, a first transistor TR21, a second transistor TR22, and a resistive circuit 230.

The resistive circuit 230 includes first through fourth resistors R21, R22, R23 and R24. The first and second transistors TR21 and TR22 may be pMOS transistors.

The first and second inverters 210 and 220 receive an input voltage Vin. A divided voltage Vfb2 at a first node N21 may be determined according to the input voltage Vin.

An output terminal of the first inverter 210 is connected to a gate of the first transistor TR21 and an output of the second inverter 220 is connected to a gate of the second transistor TR22. The first transistor TR21 has a first terminal connected to an output voltage Vout2 and a second terminal connected to a first terminal of the second transistor TR22.

The first resistor R21 is connected between the first and second terminals of the first transistor TR21. The second resistor R22 is connected between the first and second terminals of the second transistor TR22.

The second terminal of the second transistor TR22 is also connected to a second node N22. The third resistor R23 is connected between the first node N21 and the second node N22. The fourth resistor R24 is connected between a ground voltage and the first node N21.

Unlike the voltage regulator 100 illustrated in FIG. 1, the voltage regulator 200 illustrated in FIG. 2 can generate four different voltage levels (e.g., a voltage level of the first node N21, a voltage level of the second node N22, a voltage level of the third node N23, and a voltage level of an output voltage node). In addition, the output voltage Vout2 is used as a power supply voltage for the first and second inverters 210 and 220. Accordingly, the voltage regulator 200 is advantageous in that it does not affect the PSRR.

However, when the output voltage Vout2 of the voltage regulator 200 is very low, for example, when the voltage level of the second node N22 is lower than the threshold voltage level of the second transistor TR22, the second transistor TR22 may not be switched.

In this case, even when the output voltage Vout2 having the voltage level of the second node N22 is intended to be obtained, a voltage level greater than the voltage level of the second node N22 may be formed for the output voltage Vout2. In other words, the voltage regulator 200 has difficulty in driving a low voltage. A voltage regulator 300 illustrated in FIG. 3 may address this problem.

Figure 3:
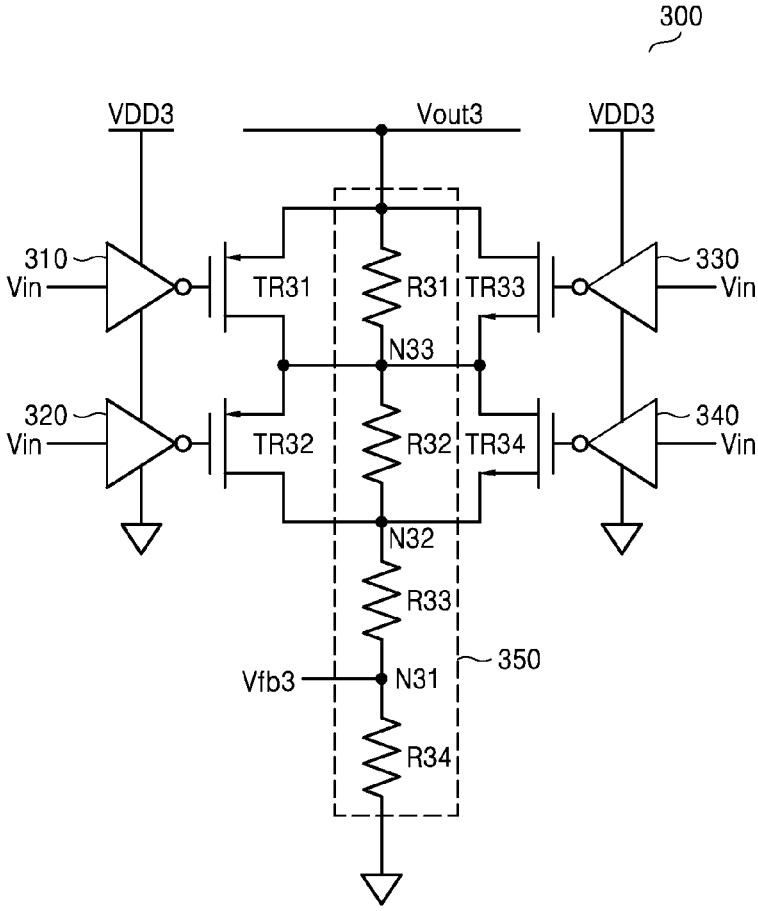
FIG. 3 is a diagram of a voltage regulator in a further comparison example.

FIG. 3 is a diagram of the voltage regulator 300 in a further comparison example. Referring to FIG. 3, the voltage regulator 300 includes a first inverter 310, a second inverter 320, a third inverter 330, a fourth inverter 340, a first transistor TR31, a second transistor TR32, a third transistor TR33, a fourth transistor TR34, and a resistive circuit 350.

The resistive circuit 350 includes first through fourth resistors R31, R32, R33 and R34. The first and second transistors TR31 and TR32 may be pMOS transistors and the third and fourth transistors TR33 and TR34 may be n-type MOS (nMOS) transistors.

The first through fourth inverters 310 through 340 receive an input voltage Vin. According to the input voltage Vin, a divided voltage Vfb3 at a first node N31 may be determined.

An output terminal of the first inverter 310 is connected to a gate of the first transistor TR31. An output terminal of the second inverter 320 is connected to a gate of the second transistor TR32. An output terminal of the third inverter 330 is connected to a gate of the third transistor TR33. An output terminal of the fourth inverter 340 is connected to a gate of the fourth transistor TR34.

A first terminal of the first transistor TR31 and a first terminal of the third transistor TR33 are connected to an output voltage Vout3. A second terminal of the first transistor TR31 and a second terminal of the third transistor TR33 are respectively connected to a first terminal of the second transistor TR32 and a first terminal of the fourth transistor TR34.

The first resistor R31 is connected between the first and second terminals of the first transistor TR31. The second resistor R32 is connected between the first and second terminals of the second transistor TR32.

The second terminal of the second transistor TR32 is also connected to a second node N32. The third resistor R33 is connected between the first node N31 and the second node N32. The fourth resistor R34 is connected between a ground voltage and the first node N31.

A predetermined power supply voltage VDD3 is used as a power supply voltage for the first through fourth inverters 310 through 340.

Unlike in the voltage regulator 200 illustrated in FIG. 2, in the voltage regulator 300 illustrated in FIG. 3, even when the output voltage Vout3 is very low, for example, when the voltage level of the second node N32 is lower than the threshold voltage level of the second transistor TR32, the third and fourth transistors TR33 and TR34 can be switched. Accordingly, when the output voltage Vout3 having the voltage level of the second node N32 is intended to be obtained, it can be obtained under the same conditions as the voltage regulator 200.

However, since the voltage regulator 300 uses the predetermined power supply voltage VDD3 as the power supply voltage for the first through fourth inverters 310 through 340, it deteriorates the PSRR.

Figure 4:
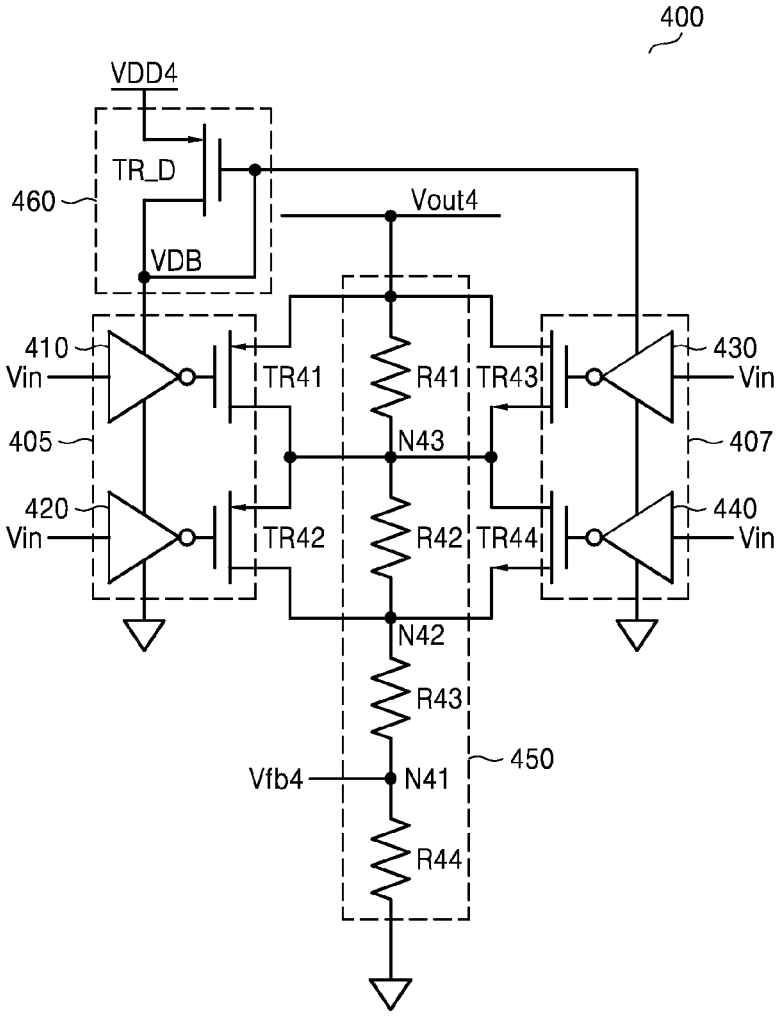
FIG. 4 is a diagram of a voltage regulator according to an exemplary embodiment.

FIG. 4 is a diagram of a voltage regulator 400 according to an exemplary embodiment. Referring to FIG. 4, the voltage regulator 400 includes a first driver circuit 405, a second driver circuit 407, a compensation circuit 460, and a resistive circuit 450. The compensation circuit 460 may include a diode-connected transistor TR_D.

The first driver circuit 405 includes a first inverter 410, a second inverter 420, a first transistor TR41, and a second transistor TR42. The second driver circuit 407 includes a third inverter 430, a fourth inverter 440, a third transistor TR43, and a fourth transistor TR44.

The resistive circuit 450 includes a first through fourth resistors R41, R42, R43 and R44. The diode-connected transistor TR_D and the first and second transistors TR41 and TR42 may be pMOS transistors. The third and fourth transistors TR43 and TR44 may be nMOS transistors. The first through fourth inverters 410 through 440 receive an input voltage Vin. A divided voltage Vfb4 at a first node N41 may be determined according to the input voltage Vin.

An output terminal of the first inverter 410 is connected to a gate of the first transistor TR41. An output terminal of the second inverter 420 is connected to a gate of the second transistor TR42. An output terminal of the third inverter 430 is connected to a gate of the third transistor TR43. An output terminal of the fourth inverter 440 is connected to a gate of the fourth transistor TR44.

A first terminal of the first transistor TR41 and a first terminal of the third transistor TR43 are connected to an output voltage Vout4. A second terminal of the first transistor TR41 and a second terminal of the third transistor TR43 are respectively connected to a first terminal of the second transistor TR42 and a first terminal of the fourth transistor TR44.

The first resistor R41 is connected between the first and second terminals of the first transistor TR41. The second resistor R42 is connected between the first and second terminals of the second transistor TR42.

The second terminal of the second transistor TR42 is also connected to a second node N42. The third resistor R43 is connected between the first node N41 and the second node N42. The fourth resistor R44 is connected between a ground voltage and the first node N41.

The diode-connected transistor TR_D has a first terminal connected to a predetermined power supply voltage VDD4 and a second terminal and a gate which are connected to each other. A voltage at the second terminal and the gate of the diode-connected transistor TR_D is used as a power supply voltage VDB for the first through fourth inverters 410 through 440.

Unlike in the voltage regulator 300 illustrated in FIG. 3, in the voltage regulator 400 illustrated in FIG. 4, a power supply voltage VDB lower than the predetermined power supply voltage VDD4 is applied to the first through fourth inverters 410 through 440 using the diode-connected transistor TR_D corresponding to a pMOS transistor.

Figure 5:
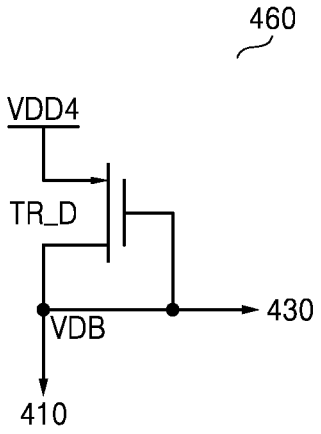
FIG. 5 is a diagram of a compensation circuit according to an exemplary embodiment.
Figure 6:
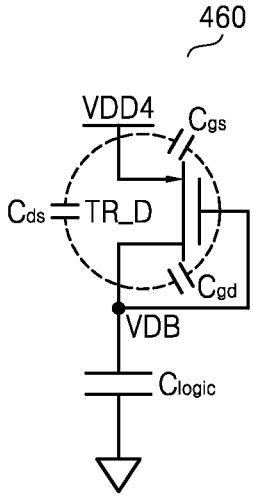
FIG. 6 is a diagram showing the compensation circuit illustrated in FIG. 5 and capacitances formed at the compensation circuit.
Figure 7:
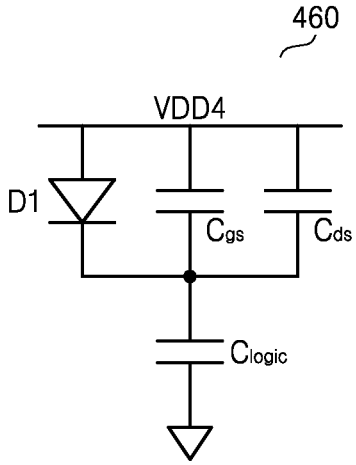
FIG. 7 is a diagram of an equivalent circuit of the compensation circuit illustrated in FIG. 6.

FIG. 5 is a diagram of the compensation circuit 460 according to an exemplary embodiment. FIG. 6 is a diagram showing the compensation circuit 460 illustrated in FIG. 5 and capacitances formed at the compensation circuit 460. FIG. 7 is a diagram of an equivalent circuit of the compensation circuit 460 illustrated in FIG. 6.

Referring to FIGS. 5 and 6, the compensation circuit 460 includes the diode-connected transistor TR_D which has parasitic capacitances $C_{gs}$, $C_{gd}$ and $C_{ds}$ among terminals.

The compensation circuit 460 is also connected to a logic capacitance $C_{logic}$ generated at logic components (e.g., the first through fourth inverters 410 through 440 or the first through fourth transistors TR41 through TR44) connected thereto. In detail, the logic capacitance $C_{logic}$ is connected to a drain of the diode-connected transistor TR_D.

Referring to FIG. 7, the diode-connected transistor TR_D is illustrated as a diode D1 and the parasitic capacitances $C_{gs}$ and $C_{ds}$ are illustrated together.

For instance, when $V_{DC}+V_s \sin(wt)$ (where $V_{DC}$ is a direct current (DC) voltage and $V_S$ is the amplitude of a sine wave) is applied as the predetermined power supply voltage VDD4, the voltage VDB applied to the first through fourth inverters 410 through 440 is given by Equation 2:

$$VDB = V_{DC} - V_{DF} + V_S \frac{C_{gs} + C_{ds}}{C_{gs} + C_{ds} + C_{logic}} \sin(wt), \quad \text{(Equation 2)}$$

where $V_{DF}$ is a diode forward voltage drop.

Consequently, according to the voltage regulator 400 illustrated in FIG. 4, a DC voltage level is lower than the predetermined power supply voltage VDD4 by the diode forward voltage drop $V_{DF}$ and the amplitude of the sine wave, i.e., voltage fluctuation is reduced. Accordingly, the voltage regulator 400 improves the PSRR unlike the voltage regulator 300 illustrated in FIG. 3 and can be driven at a low voltage since it has the structure as shown in FIG. 3. The voltage regulator 400 can also drive (or provide) a high output voltage.

As described above, a voltage regulator according to an exemplary embodiment improves the PSRR and can drive (or provide) a low output voltage as well as a high output voltage.

Figure 8:
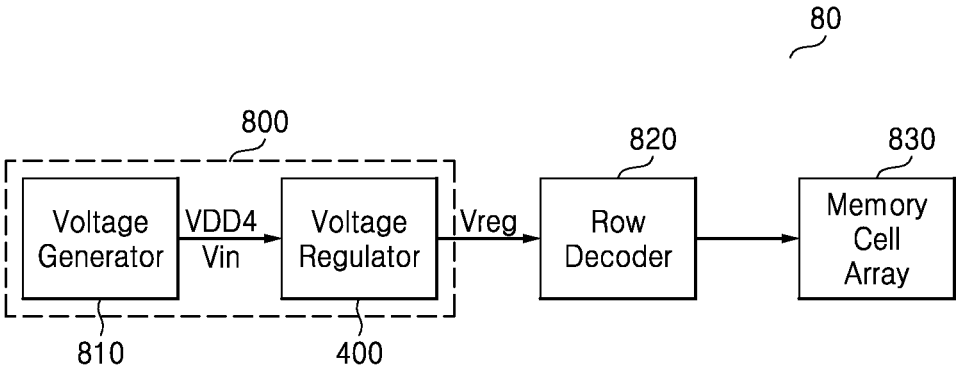
FIG. 8 is a diagram of a non-volatile memory device according to an exemplary embodiment.

FIG. 8 is a diagram of a non-volatile memory device 80 according to an exemplary embodiment. The non-volatile memory device 80 includes a word line voltage generation circuit 800, a row decoder 820, and a memory cell array 830. The word line voltage generation circuit 800 includes a voltage generator 810 and the voltage regulator 400 illustrated in FIG. 4. The voltage generator 810 applies the predetermined power supply voltage VDD4 and the input voltage Vin to the voltage regulator 400. The voltage regulator 400 applies a regulated voltage Vreg to the row decoder 820 based on those voltages VDD4 and Vin.

The row decoder 820 selects a row in the memory cell array 830 based on the regulated voltage Vreg and provides the regulated voltage Vreg to the selected row.

The regulated voltage Vreg may be a voltage that has been adjusted to different levels by the voltage regulator 400.

Although the voltage regulator 400 is included in the non-volatile memory device 80 in the exemplary embodiment illustrated in FIG. 8, the voltage regulator 400 is not required to be included in the non-volatile memory device 80, and may be applied to various fields.

While the present inventive concept has been particularly shown and described with reference to exemplary embodiments thereof, it will be understood by those of ordinary skill in the art that various changes in forms and details may be made therein without departing from the spirit and scope of the present inventive concept as defined by the following claims.

What is claimed is:

1. A voltage regulator comprising: a resistive circuit configured to output a divided voltage; a driver circuit configured to be connected to the resistive circuit and set the divided voltage; and a compensation circuit including a diode-connected transistor which includes: a first terminal which is configured to receive a predetermined voltage, and interconnected second terminal and gate which are connected to the driver circuit and configured to supply a power supply voltage to the driver circuit, wherein a value of the power supply voltage is lower than a value of the predetermined voltage, and the driver circuit is configured to set the divided voltage based on the power supply voltage received from the interconnected second terminal and gate of the diode-connected transistor, and comprises: an inverter configured to generate an output voltage based on the power supply voltage and an input voltage input to the inverter; and a transistor configured to have a gate connected to an output terminal of the inverter, and a first terminal and a second terminal which are connected to the resistive circuit.

2. The voltage regulator of claim 1, wherein the value of the power supply voltage is lower than the value of the predetermined voltage by a diode forward voltage drop.

3. The voltage regulator of claim 1, wherein the resistive circuit comprises at least two resistors connected in series to each other, and at least one of the at least two resistors are connected between the first and second terminals of the transistor of the driver circuit.

4. The voltage regulator of claim 3, wherein a first end of the series of the at least two resistors is connected to a ground voltage.

5. The voltage regulator of claim 4, wherein an output voltage of the voltage regulator is measured at a second end of the series of the at least two resistors.

6. The voltage regulator of claim 1, wherein the diode-connected transistor is a p-type metal oxide semiconductor (pMOS) transistor.

7. The voltage regulator of claim 1, wherein the transistor is an n-type metal oxide semiconductor (nMOS) transistor or a p-type metal oxide semiconductor (pMOS) transistor.

8. A memory device comprising:

the voltage regulator of claim 1; and a row decoder configured to be connected to the voltage regulator and to select a row in a memory cell array using a voltage output from the voltage regulator.

9. A voltage regulator comprising:

a resistive circuit comprising a first resistor and a second resistor connected in series to each other, and configured to output a divided voltage of the voltage regulator;

a first metal oxide semiconductor (MOS) transistor, which has a first terminal connected to a first end of a first resistor, and a second MOS transistor which has a second terminal connected to a second end of a second resistor;

a pair of inverters configured to have output terminals connected to respective gates of the first and second MOS transistors; and a diode-connected transistor which is configured to be connected to the pair of inverters, and comprises a first terminal configured to receive a predetermined voltage, a second terminal configured to output a power supply voltage to the pair of inverters, and a gate diode-connected to the second terminal, wherein a value of the power supply voltage is lower than a value of the predetermined voltage, the pair of inverters generates an output voltage using the power supply voltage output by the second terminal and an input voltage input to the pair of inverters, and the first and second MOS transistors are turned on or off based on the output voltage to set the divided voltage of the voltage regulator.

10. The voltage regulator of claim 9, wherein the value of the power supply voltage is lower than the value of the predetermined voltage by a diode forward voltage drop.

11. The voltage regulator of claim 10, wherein a first end of the series of the first and second resistors is connected to a ground voltage.

12. The voltage regulator of claim 11, wherein an output voltage of the voltage regulator is measured through a second end of the series of the first and second resistors.

13. The voltage regulator of claim 9, wherein the diode-connected transistor is a p-type metal oxide semiconductor (pMOS) transistor.

14. A voltage regulator comprising:

a resistive circuit that outputs a divided voltage;

a first pair of inverters that respectively outputs an output voltage to a first pair of metal-oxide-semiconductor (MOS) transistors;

a second pair of inverters that respectively outputs an output voltage to a second pair of MOS transistors; and a compensation circuit including a diode-connected transistor which includes:

a first terminal which is configured to receive a predetermined voltage, interconnected second terminal and gate which are connected to the first pair of inverters and the second pair of inverters and configured to supply a power supply voltage to the first pair of inverters and the second pair of inverters, wherein a value of the power supply voltage is lower than a value of the predetermined voltage, and the divided voltage output by the resistive circuit is based on the power supply voltage received by the first pair of inverters and the second pair of inverters.

15. The voltage regulator of claim 14, wherein the first pair of MOS transistors are p-type MOS (pMOS) transistors, and the second pair of MOS transistors are n-type MOS (nMOS) transistors.

16. The voltage regulator of claim 14, wherein the resistive circuit comprises at least two resistors connected in series to each other;

a first end of the series of the at least two resistors is connected to a first terminal of a first transistor of the first pair of MOS transistors and a first terminal of a first transistor of the second pair of MOS transistors; and a second end of the series of the at least two resistors is connected to a second terminal of a second transistor of the first pair of MOS transistors and a second terminal of a second transistor of the second pair of MOS transistors.

17. The voltage regulator of claim 16, wherein a second terminal of the first transistor of the first pair of MOS transistors is connected to a first terminal of the second transistor of the first pair of MOS transistors; and a second terminal of the first transistor of the second pair of MOS transistors is connected to a first terminal of the second transistor of the second pair of MOS transistors.

* * * * *